US005197991A

United States Patent [19]

Rembold

[11] Patent Number: 5,197,991

[45] Date of Patent: Mar. 30, 1993

[54] PROCESS FOR THE PHOTOCHEMICAL STABILIZATION OF WOOL WITH TRIAZINYL ULTRA-VIOLET ABSORBING COMPOUND

[75] Inventor: Manfred Rembold, Aesch, Switzerland

[73] Assignee: Ciba-Geigy Corporation, Ardsley, N.Y.

[21] Appl. No.: 755,714

[22] Filed: Sep. 6, 1991

[30] Foreign Application Priority Data

Sep. 13, 1990 [CH] Switzerland ..... 2973/90

[51] Int. Cl.[5] ..... D06M 13/35; D06M 13/358; D06P 1/64; D06P 3/14

[52] U.S. Cl. ..... 8/490; 8/442; 8/566; 8/115.59; 8/917; 252/8.6; 252/8.7; 252/8.9

[58] Field of Search ..... 8/490, 442, 115.59

[56] References Cited

U.S. PATENT DOCUMENTS 3,444,164 5/1969 Luethi et al. ..... 8/115.6
4,775,386 10/1988 Reinert et al. ..... 8/442
4,950,304 8/1990 Reinert et al. ..... 8/566

FOREIGN PATENT DOCUMENTS 0165608 12/1985 European Pat. Off. .

OTHER PUBLICATIONS

Chem. Abstr. 105:124162k.

*Primary Examiner*—A. Lionel Clingman
*Attorney, Agent, or Firm*—Marla Mathias; Edward McC. Roberts

[57] ABSTRACT

A process for the photochemical stabilization of wool is described, which comprises treating the wool with an aqueous solution comprising at least one UV absorber of the formula

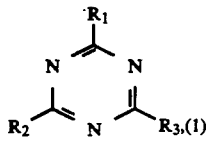

in which at least one of the substituents $R_1$, $R_2$ and $R_3$ is a radical of the formula

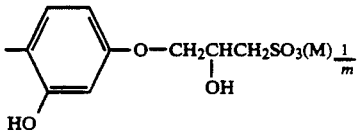

(2)

in which

M is hydrogen; or an equivalent of a cation;

m is 1 or 2, and the remaining substituent(s), independently of one another, are $C_1$–$C_{12}$alkyl; $C_1$–$C_{12}$alkoxy; $C_1$–$C_{12}$-alkylthio; $C_1$–$C_{12}$alkylamino; di-$C_1$–$C_{12}$-alkylamino; phenyl; phenoxy; phenylthio, anilino; or N-phenyl-N-$C_1$–$C_4$alkylamino;

The UV absorbers can be used in a wide pH range and effectively reduce yellowing of the wool.

10 Claims, No Drawings

PROCESS FOR THE PHOTOCHEMICAL STABILIZATION OF WOOL WITH TRIAZINYL ULTRA-VIOLET ABSORBING COMPOUND

The present invention relates to a process for the photochemical stabilisation of wool or wool containing fibres, to an agent and a liquor for carrying out the process and the fibre material treated therewith.

The process according to the invention comprises treating the wool or the wool containing fibrous material in an aqueous liquor comprising at least one UV absorber of the formula

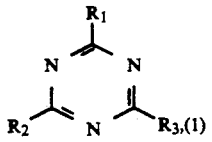

(1)

in which at least one of the substituents $R_1$, $R_2$ and $R_3$ is a radical of the formula

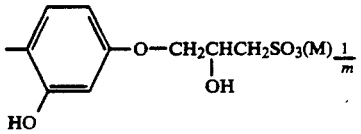

(2)

in which

M is hydrogen; sodium; potassium; calcium; magnesium; ammonium; mono-, di-, tri-or tetraalkylammonium; mono-, di- or trihydroxyalkylammonium; or ammonium that is independently substituted two or three times by hydroxyalkyl and alkyl;

m is 1 or 2, and the remaining substituent(s), independently of one another, are unsubstituted or substituted $C_1$–$C_{12}$alkyl, $C_1$–$C_{12}$alkoxy, $C_1$–$C_{12}$alkylthio, mono-$C_1$–$C_{12}$alkylamino or di-$C_1$–$C_{12}$alkamino; unsubstituted or substituted phenyl, phenoxy, phenylthio, anilino or N-phenyl-N-$C_1$–$C_4$-alkylamino.

The substituents as individual radical (for example alkyl) as well as part of a larger, coposed radical (for example alkoxy) particularly have the following meanings:

Examples of $C_{1'}$-$_{C12}$alkyl are methyl, ethyl, propyl, butyl, pentyl, hexyl, heptyl, octyl, nonyl, decyl, undecyl or dodecyl or isomers of these radicals. Particularly preferred alkyl radicals contain 1 to 4 carbon atoms.

The alkyl radicals in mono-, di-, tri- or tetraalkylammonium in particular are, independently of one another, butyl, propyl, ethyl and in particular methyl.

Mono-, di- or tri-hydroxyalkylammonium are $C_1$–$C_4$-hydroxyalkylammonia cations that are in particular derived from ethanolamine, di-ethanolamine or triethanolamine. Cations derived from mixed $C_1$–$C_4$-hydroxyalkyl-$C_1$–$C_4$-alkylamines, in particular N-methyl-N-ethanolamine or N,N-dimethyl-N-ethanolamine are also within the invention.

The phenyl radicals may be further substituted by alkyl- or alkoxy of 1 to 12 carbon atoms like methyl, tert.-butyl, pentyl, octyl, nonyl, decyl, dodecyl, methoxy, butoxy, or pentoxy or cyclopentyl, cyclohexyl and halogen, in particular chlorine.

The radicals $R_1$, $R_2$ and $R_3$ can be further substituted. Examples of preferred substituents of the $C_1$–$C_{12}$alkyl-, $C_1$–$C_{12}$alkoxy-, $C_1$–$C_{12}$alkylthio-, mono-$C_1$–$C_{12}$alkylamino- and di-$C_1$–$C_{12}$alkylamino-radicals are $C_1$–$C_4$alkoxy, in particular methoxy, or hydroxyl, phenyl or carbalkoxy having 2 to 9 carbon atoms.

Examples of suitable compounds of the formula (1) are the potassium salt of these compounds in which $R_1$ is phenyl and $R_2$ and $R_3$ are each the radical of the formula (2) or the sodium salt of the compound of the formula (1) in which $R_1$ is p-chlorophenyl and $R_2$ and $R_3$ are each the radical of the formula (2).

Also preferred are compounds of the formula (1) in which

M is hydrogen and $R_2$ and $R_3$ are each the each the radical of the formula (2) and compounds of the formula (1)

M is hydrogen and $R_3$ is the radical of the formula (2).

Of particular interest are UV absorbers of the formula

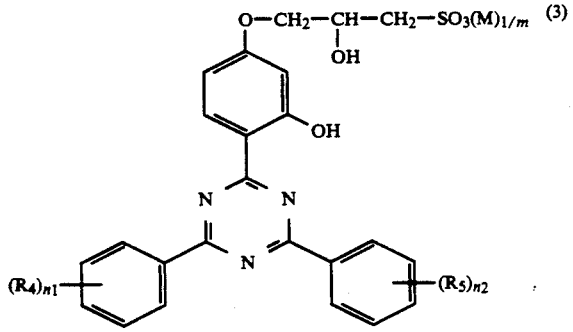

(3)

in which $R_4$ and $R_5$, independently of one another, are $C_1$–$C_{12}$alkyl;

m is 1 or 2;

M is hydrogen; sodium; potassium; calcium; magnesium; ammonium; or tetraalkylammonium; and $n_1$ and $n_2$ are 0; 1; or 2.

Of these, particular preference is given to compounds of the formula (3) in which M is hydrogen;

$R_4$ and $R_5$ are methyl; and $n_1$ and $n_2$ are 1 or 2.

Also preferred are compounds of formula (1), in which $R_1$ is phenyl, tolyl or xylyl; and compounds of formula (1), in which $R_1$ and $R_2$ is phenyl, tolyl or xylyl.

In the above preferred compounds special emphasis is given to compounds in which M is hydrogen, sodium or potassium, preference is given to hydrogen.

Compounds of particular interest are:

2,4-diphenyl-6-[2-hydroxy-4-(2-hydroxy-3-sulfopropoxy)-phenyl]-1,3,5-triazine (comp. no. 101), 2-phenyl-4,6-bis-[2-hydroxy-4-(2-hydroxy-3-sulfopropoxy)-phenyl]-1,3,5-triazine (comp. no. 102), 2,4-bis-(2,4-dimethylphenyl)-6-[2-hydroxy-4-(2-hydroxy-3-sulfopropoxy)-phenyl]-1,3,5-triazine (comp. no. 103) and 2,4-bis-(4-methylphenyl)-6-[2-hydroxy-4-(2-hydroxy-3-sulfopropoxy)-phenyl]-1,3,5-triazine (comp. no. 104).

The compounds of the formula (1) can be prepared in a manner known per se, for example by the processes described in EP-A-0 165 608.

The amount of UV absorber to be added depends on the substrate and the desired stabilisation. In general, 0.1 to 5, preferably 0.3 to 3% by weight, relative to the wool, are added.

In addition to wool fibres, the dyeings applied to the wool are also photochemically stabilised by the process according to the invention. Suitable dyeings to be stabilised according to the invention are those which are produced by acid or metal complex dyes, for example 1:2 chromium, 1:2 cobalt complex dyes or copper complex dyes.

The amount of dye to be added can vary within wide limits, it being possible to add 0.01 to 10% by weight, relative to the wool, of dye. However, amounts of 0.05 to 2% by weight are preferred.

The compounds of the formula (1) are applied according to the invention from an aqueous bath. Application can take place before, during or after dyeing, dyeing and photochemical stabilisation being preferrably carried out in the same bath. Advantageously, dyeing and photochemical stabilisation are carried out simultaneously. For this purpose, UV absorber, dye and chemicals customary for the dyeing process are jointly added to the aqueous dyeing liquor.

Suitable customary chemicals are mineral acids, for example sulfuric acid or phosphoric acid, organic acids, advantageously aliphatic carboxylic acids, such as formic acid, acetic acid, oxalic acid or citric acid, and/or salts, such as ammonium acetate, ammonium sulfate or sodium acetate. The acids serve in particular for adjusting the pH of the liquors used according to the invention, which pH-value can be variied within broad limits, preferably between 3 and 8.

The dyeing liquors additionally contain commercially available dispersants and levelling agents and can furthermore contain aids customary in dyeing technology, such as electrolytes, wetting agents, defoaming agents, foam-preventing agents, thickeners or wool-protecting agents.

Special apparatuses are not required for carrying out the process according to the invention. Any continuous and batchwise dyeing processes together with the dyeing apparatuses customary therefor, for example open baths, top-dyeing, hank-dyeing or pack-dyeing apparatuses, jigs, pad-mangles, beam-dyeing apparatuses, circulation or jet-dyeing apparatuses or winches can be used for the treatment. Advantageously, the process according to the invention is carried out by the exhaust method, apparatuses for dyeing at atmospheric pressure being used.

In the exhaust method, the liquor ratio can be selected within a wide range, for example 5:1 to 300:1, preferably 10:1 to 50:1. Advantageously, dyeing is carried out at a temperature of 30° to 120° C., preferably 50° to 98° C.

In the continuous process, the liquor pick up is advantageously 30–400% by weight, preferably 75–250% by weight. The applied dyes are fixed by subjecting the fibre material to a heat treatment. The fixing process can also be carried out by the cold pad-batch method.

The heat treatment is preferably carried out by a steaming process, in which the material is treated in a steaming chamber with steam which may be superheated at a temperature of 98° to 105° C. for, for example 1 to 7, preferably 1 to 5, minutes. Fixing of the dyes and of the compounds of the formula (1) by the cold pad-batch method can be carried out by storing the impregnated and preferably unwound material at room temperature (15° to 30° C.), for example for 3 to 24 hours, the cold pad-batch time being dependent, as is known, on the type of the applied dye.

When application of the dye is carried out simultaneously, the treatment time depends on the dyeing time, which is in the usual range and, as a rule, is 20 to 120 minutes. If the UV absorber is added before or after the dyeing step, the treatment time is 15 to 60 minutes.

After the dyeing process or fixing is complete, the dyeings produced are rinsed and dried in the usual manner.

The process according to the invention gives wool dyeings and fibres having good thermal and photochemical stability. The abrasive and tensile strengh of the fibres is also improved.

Examples of dyes of this type are described in Colour Index, 3rd edition, 1971, Volume 4.

A suitable fibre material which can be dyed according to the invention is wool. The wool can have been given a normal or felt-free finishing. Apart from pure wool fibres, fibre blends comprising wool and synthetic polyamide or wool/polyester blends are suitable, for example a wool/polyamide knitted fabric material in a mixing ratio of 70:30. In principle, the pure or blended fibre material can be present in a wide range of processing forms, for example as fibre, yarn, woven fabric, knitted fabric, nonwoven or pile material.

The present invention is particularly advantageously suitable for the treatment of fibre material exposed to light and heat and is used, for example, on automobile upholstery material or carpet. The UV absorbers used according to the invention can be used in a wide pH range, thus also making them suitable for application in wool blends with other fibres, for example wool and polyamide.

The present invention also relates to a composition for carrying out the process according to the invention, which contains at least one UV absorber of the formulae (1) or (3) as defined herinbefore and conventional formulation aids, like wetting and diluting agents.

The examples which follow illustrate the invention. Parts and percentages are by weight.

EXAMPLE 1

4 10 g specimens of a wool serge fabric are dyed in an open dyeing apparatus, for example an ®AHIBA, at a liquor ratio of 25:1. To this end, 4 liquors are prepared containing the following additives:

Liquor 1 (Specimen 1)

0.4 ml/l of a nonionic dispersant 0.5%, for example the adduct of 1 mol of 4-isooctylphenol with 8 mol of ethylene oxide 5% of Glauber salt
1 g/l of sodium acetate
1% of an anionic levelling agent
0.01% of the dye of the formula -continued

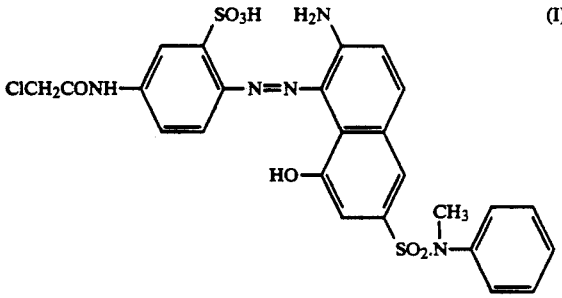

(I)

and 0.01% of the dye of the formula

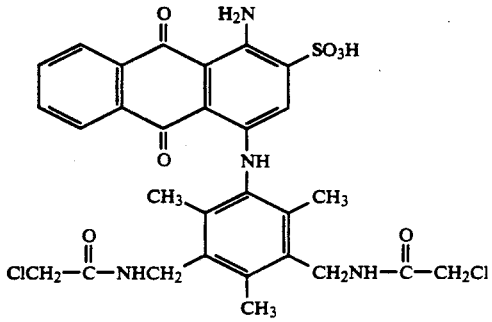

(II)

Liquor 2 (Specimen 2)

This liquor additionally contains 1% of the compound of the formula

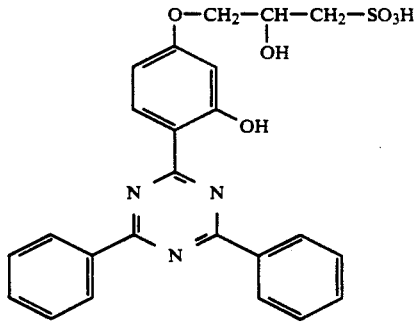

(101)

Liquor 3 (Specimen 3)

This liquor is the same as Liquor 1, except that it additionally contains 1% of the compound of the formula

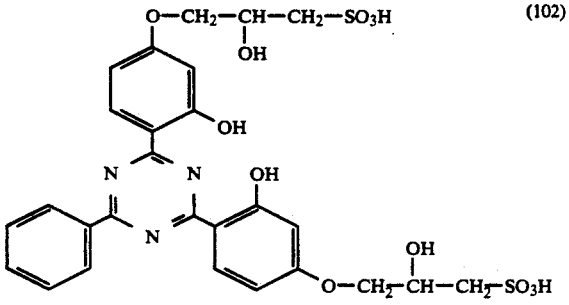

(102)

Liquor 4 (Specimen 4)

This liquor is the same as Liquor 1, except that it additionally contains 1% of the compound of the formula

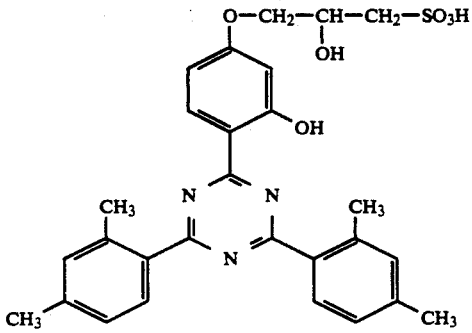

(103)

Liquor 5 (Specimen 5):

This liquor is the same as Liquor 1, except that it additionally contains 1% of the compound of the formula

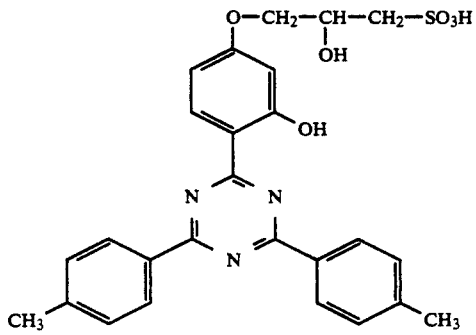

(104)

Liquor 6 (Specimen 6)

This liquor is the same as Liquor 2, except that no dye is used (blank dyeing containing UV absorber).

Liquor 7 (Specimen 7)

This liquor is the same as Liquor 1, except that no dye is used (blank dyeing without UV absorber).

If desired, the pH is brought to 4.5 with 10% acetic acid.

The dye bath is entered at 50°, heated to 98° over a period of 30 minutes and dyeing is carried out at this temperature. The dye bath is then cooled to 60° and the dyed material is rinsed with cold water. The specimens are then dried at room temperature.

The specimens are tested for light fastness according to DIN 75202 (FAKRA). In Table 1, the light fastnesses according to grey scale and the colorimetric ratings according to DIN 6174 (CIELAB formula) are listed.

TABLE 1

| | FAKRA* 72 hours | ΔE** 72 hours | FAKRA* 144 hours | ΔE** 144 hours | Tear strength [dekaN]*** |
|---|---|---|---|---|---|
| Specimen 1 | 2.0 | 5.8 | 1.0 | 9.8 | — |
| Specimen 2 | 4.0 | 0.4 | 2.5 | 3.8 | — |
| Specimen | 4.0 | 1.4 | 3.0 | 4.3 | — |

TABLE 1-continued

| | FAKRA* 72 hours | ΔE** 72 hours | FAKRA* 144 hours | ΔE** 144 hours | Tear strength [dekaN]*** |
|---|---|---|---|---|---|
| 3 Specimen 4 | 4.0 | 1.3 | 2.5 | 4.8 | — |
| 4 Specimen 5 | 3.5 | 2.9 | 2.5 | 6.5 | — |
| 5 Specimen 6 | — | — | — | 1.3 | 10.8 |
| 6 Specimen 7 | — | — | — | 8.6 | 7.5 |

*Evaluation by grey scale
**CIELAB, D 65, 10°
***Tear strength according to DIN 53858

EXAMPLE 2

2 10 g specimens of a wool serge fabric are dyed in an open dyeing apparatus, for example an ®AHIBA, at a liquor ratio of 25:1.2 liquors are prepared containing the following additives:

Liquor 1 (Specimen 1)

6% of ammonium sulfate; 5% of Glauber salt; 1 g/l of sodium acetate; 1% of an anionic levelling agent based on an alkylamino polyglycol ether 0.01% of the dye of the formula

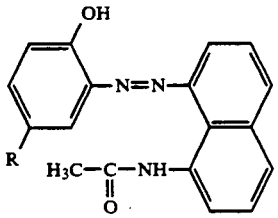

(III)

and 0.01% of the dye of the formula

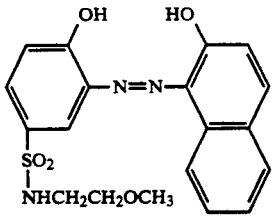

(IV)

Liquor 2 (Specimen 2)

This liquor additionally contains 1% of the compound of the formula (101).

Liquor 3 (Specimen 3)

This liquor contains 1% of the compound of the formula (102) compared with Liquor 1.

Liquor 4 (Specimen 4)

This liquor contains 1% of the compound of the formula (103) compared with Liquor 1.

Liquor 5 (Specimen 5)

This liquor contains 1% of the compound of the formula (104) compared with Liquor 1.

The pH of the liquor reaches 6.2. The treatment is continued and evaluation is carried out as described in Example 1.

The results of the light fastness evaluation are listed in Table 2:

TABLE 2

| | FAKRA* 72 hours | ΔE** 72 hours | FAKRA* 144 hours | ΔE** 144 hours |
|---|---|---|---|---|
| Specimen 1 (Liquor 1) | 2.5 | 4.5 | 1.5 | 7.5 |
| Specimen 2 (Liquor 2) | 4.0 | 1.5 | 3.0 | 3.6 |
| Specimen 3 (Liquor 3) | — | 1.7 | — | 3.9 |
| Specimen 4 (Liquor 4) | 4.0 | 1.7 | 3.0 | 3.7 |
| Specimen 5 (Liquor 5) | 4.0 | 2.5 | 3.0 | 5.2 |

*Evaluation according to grey scale
**CIELAB, D 65, 10°

What is claimed is:

1. A process for the photochemical stabilisation of wool or wool containing fibres, which comprises treating the wool or the wool containing fibre material with an aqueous solution comprising at least one UV absorber of the formula

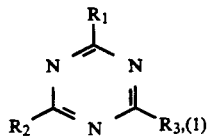

in which at least one of the substituents $R_1$, $R_2$ and $R_3$ is a radical of the formula

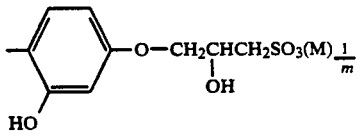

(2)

in which

M is hydrogen; sodium; potassium; calcium; magnesium; ammonium; mono-, di-, tri-or tetraalkylammonium; mono-, di- or trihydroxyalkylammonium; or ammonium that is independently substituted two or three times by hydroxyalkyl and alkyl;

m is 1 or 2, and the remaining substituent(s), independently of one another, are unsubstituted or substituted $C_1$–$C_{12}$alkyl, $C_1$–$C_{12}$alkylthio, mono-$C_1$–$C_{12}$alkylamino or di-$C_1$–$C_{12}$alkamino; unsubstituted or substituted phenyl, phenoxy, phenylthio, anilino or N-phenyl-N-$C_1$–$C_4$-alkylamino.

2. A process according to claim 1, wherein UV absorbers of the formula

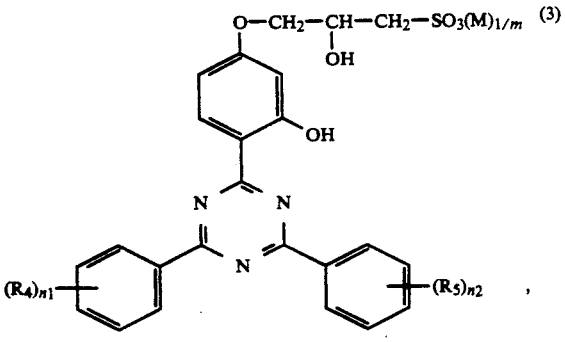

(3)

in which $R_4$ and $R_5$, independently of one another, are $C_1$–$C_{12}$alkyl;

m is 1 or 2;

M is hydrogen; sodium; potassium; calcium; magnesium; ammonium; or tetraalkylammonium; and $n_1$ and $n_2$ are 0; 1; or 2 are used.

3. A process according to claim 2, wherein UV absorbers of the formula (3) is used in which M is hydrogen;

$R_4$ and $R_5$ is methyl; and $n_1$ and $n_2$ are 1 or 2.

4. A process according to claim 1, wherein the photochemical stabilisation is carried out before, during or after dyeing.

5. A process according to claim 1, wherein the UV absorber is added to the dye bath.

6. A process according to claim 1, wherein the dyeing liquor has a pH of 3 to 8.

7. A composition for the photochemical stabilisation of wool or wool containing fibre material, comprising at least one UV absorber of the formula

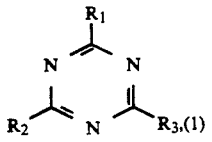

(1)

in which at least one of the substituents $R_1$, $R_2$ and $R_3$ is a radical of the formula

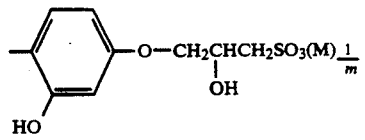

(2)

in which

M is hydrogen; sodium; potassium; calcium; magnesium; ammonium; mono-, di-tri tetraalkylammonium; mono-, di- or trihydroxyalkylammonium; or ammonium that is independently substituted two or three times by hydroxyalkyl and alkyl;

m is 1 or 2, and the remaining substituent(s), independently of one another, are unsubstituted or substituted $C_1$–$C_{12}$alkyl, $C_1$–$C_{12}$alkoxy, $C_1$–$C_{12}$alkythio, mono-$C_1$–$C_{12}$alkylamino or di-$C_1$–$C_{12}$alkamino; unsubstituted or substituted phenyl, phenoxy, phenylthio, anilino or N-phenyl-N-$C_1$–$C_4$-alkylamino and a wetting agent.

8. A composition according to claim 7, which comprises a UV absorber of the formula

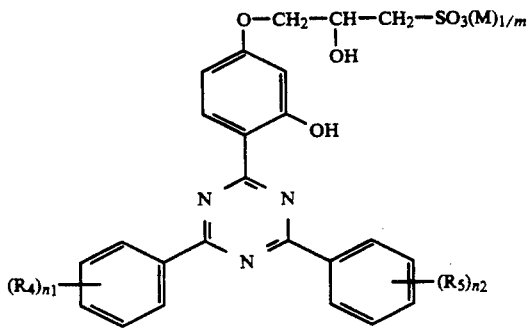

(3)

in which $R_4$ and $R_5$, independently of one another, are $C_{1-C12}$alkyl;

m is 1 or 2;

M is hydrogen; sodium; potassium; calcium; magnesium; ammonium; or tetraalkylammonium; and $n_1$ and $n_2$ are 0; 1; or 2.

9. A liquor for carrying out the process according to claim 1, which comprises the UV absorber of the formula (1) in an amount of 0.1 to 5% by weight.

10. The fibre material treated according to claim 1.

* * * * *